United States Patent [19]

Kiesewetter et al.

[11] 4,077,317

[45] Mar. 7, 1978

[54] APPARATUS FOR IMPRINTING AN ELONGATED MEMBER

[75] Inventors: Werner Kiesewetter, Neustadt; Emil Bernhardt, Thann; Robert Hutterer, Haarbrucken, all of Germany

[73] Assignee: Siemens Aktiengesellschaft, Berlin and Munich, Germany

[21] Appl. No.: 628,817

[22] Filed: Nov. 4, 1975

[30] Foreign Application Priority Data

Nov. 4, 1974 Germany ..... 2452636

[51] Int. Cl.[2] ..... B41F 9/10

[52] U.S. Cl. ..... 101/37; 101/157; 101/167; 101/350

[58] Field of Search ..... 101/348–350, 101/366, 153–157, 167, 169, 37

[56] References Cited

U.S. PATENT DOCUMENTS

| | | | |
|---|---|---|---|
| 2,040,961 | 5/1936 | Stouch | 101/157 |
| 2,151,968 | 3/1939 | Henderson | 101/157 |
| 2,177,656 | 10/1939 | Kaddeland | 101/157 |
| 2,404,687 | 7/1946 | Carlsen et al. | 101/169 |
| 2,898,849 | 8/1959 | Gillies | 101/37 |
| 2,934,005 | 4/1960 | Gemelli | 101/37 |
| 3,635,153 | 1/1972 | Gartside | 101/157 X |
| 3,641,932 | 2/1972 | Behringer | 101/157 |
| 3,709,143 | 1/1973 | Rundell | 101/157 X |
| 3,739,717 | 6/1973 | Brown et al. | 101/366 X |

*Primary Examiner*—Edward M. Coven

*Attorney, Agent, or Firm*—Kenyon & Kenyon, Reilly, Carr & Chapin

[57] ABSTRACT

A device for imprinting an elongated filament-like member drawn at high speed has a vertically disposed grooved-rim printing wheel that rotates about a horizontal axis. An ink jet and a wiper are arranged below the horizontal diameter of the printing wheel so that the upper edge of the end of the wiper engages the groove between the edges of the printing wheel rim, with the axis of the wiper tilted at an angle of between 3° and 10° with respect to the horizontal. The end face of the wiper is bevelled from the upper edge, the bevelled surface making an included angle of 65° to 85° with the axis of the wiper.

6 Claims, 5 Drawing Figures

APPARATUS FOR IMPRINTING AN ELONGATED MEMBER

BACKGROUND OF THE INVENTION

The present invention relates to apparatus for imprinting an elongated member, and more particularly to such apparatus having a circumferentially grooved-rim printing wheel toward which an ink jet is aimed, the aperture angle of the jet being within the edges of the printing wheel rim, while an ink wiper bears against the printing wheel in opposition to its direction of rotation.

In printing devices that are currently available on the market, the printing wheel dips into an ink bath, or sometimes a wide-angle inking jet is used in place of the immersion tank. For adequate printing quality, the known devices of this kind are limited to operating speeds of about 400 m/min. The large wipers used up to now, which wipe off the ink spilled over the sides of the wheel as well as the excess ink in the concave groove of the printing wheel, act as a brake on the printing wheel, which is driven by frictional contact with the member to be imprinted in the so-called "wire drag" mode. At operating speeds above 400 m/min, this braking action often causes slippage between the elongated member and the wheel, resulting in an objectionably smeared pattern. Even the use of special inks could not remedy this situation.

U.S. Pat. No. 2,934,005, issued Apr. 26, 1960 to J. C. Gemelli, describes printing apparatus of this general type, and its disclosure is incorporated herein by reference. In the design of this patent, the printing wheels rotate on vertical axes. However, this device permits production speeds of only up to about 900 m/min. Alternatively, there have been attempts to get higher printing speeds through electronically controlled drives, but without success.

SUMMARY OF THE INVENTION

It is an object of the present invention to provide printing apparatus which permits linear operating speeds of the member to be imprinted above 900 m/min without the need for complicated drive controls.

This object is achieved by an improved printing apparatus of the type that includes a printing wheel having a rim formed with a circumferential groove conforming to the surface to be imprinted, depressed printing markings being formed in the surface of the groove; means for engaging the rim of the printing wheel in tangential, non-slip, frictional contact with an elongated member while the member is being drawn longitudinally at high speed; a nozzle positioned for aiming an ink jet at a region of the grooved rim of the wheel spaced from the area of contact with the drawn member, the nozzle producing an ink jet having an aperture angle within the edges of the rim; and a wiper, facing against the direction of wheel rotation, contacting the wheel at a location following the inking region.

In the improved arrangement of the present invention the printing wheel is mounted for rotation about a horizontal axis, with the inking region and the wiper contact location being on the lower half of the wheel, and the wiper has an end face bevelled at an angle between about 65° and 85° with respect to the top surface of the wiper, the wiper being positioned so that the upper edge of the end face contacts the groove surface of the printing wheel between the edges of the rim, with the top surface extending from the contact edge at an angle between about 3° and 10° below the horizontal.

This improved arrangement makes it possible to apply a fine ink jet to the printing wheel. The excess ink can be wiped off from the surface surrounding the printing pattern, which is below the surface (i.e. intaglio), by a wiper which follows the inking region more closely than heretofore. It is important in this connection that the individual elements of the device according to the invention cause only small friction forces and thereby make possible high draw velocities of the elongated member which is to be imprinted, without slippage between the member and the wheel. In this way, no separate drive for the printing wheel is necessary.

The ink is wiped off most effectively if the top surface of the wiper is inclined at an angle of 3° to 10°, and preferably 5° to 8°, with the horizontal and if its end face is bevelled at an angle of about 65° to 85°, and preferably about 75°, with respect to the top surface.

It may be advantageous in this connection to arrange a device for adjusting the viscosity of the printing ink in the feed line to the nozzle. It is further advantageous to arrange a stir mechanism in the mixing zone for ink and thinning medium.

The ink jet formation is improved if the neck region of the nozzle adjacent to its exit aperture has a greater length dimension than the diameter of the exit aperture, and if the wall thickness at the end of the nozzle is smaller than the diameter of the exit aperture. This prevents ink droplets from collecting behind the exit aperture, which could tear the ink jet apart of its fictitious surface.

A particularly compact and clean-cut design is obtained if the printing wheels are rotatably mounted in respective support members in the form of slides which are guided in a frame, each slide also carrying the respective nozzle, wiper and a collecting tray. Preferably, the nozzle, wiper, and collecting tray are adjustably mounted with respect to the printing wheel. In addition, if a screen with about 100 to 200 meshes per $cm^2$ is positioned over the tray to intersect the plane of the bevelled end face of the wiper, the ink can be prevented from splashing back out of the tray.

With the printing apparatus of the present invention, operating speeds in the order of 1200 m/min have been achieved for 1.5 $cm^2$ cross section of the member to be imprinted, with good results as far as the printing is concerned.

The invention will be explained in further detail with reference to an example of an embodiment schematically shown in the drawing.

DESCRIPTION OF THE PREFERRED EMBODIMENT

Figure 2:
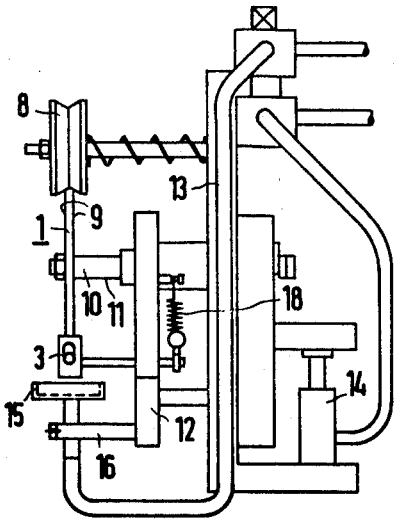
FIG. 2 is a right end view of one of the printing wheels according to FIG. 1.
Figure 4:
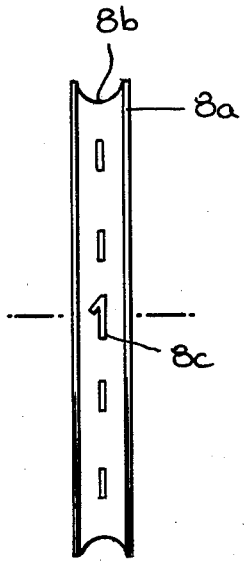
FIG. 4 is an enlarged, plan view of the printing wheel.

As shown in the Figures, a printing wheel 1 having a rim 8*a* formed with a circumferential groove 8*b* and depressed printing markings 8*c* formed in the surface of the groove (see FIG. 4) is mounted for rotation about a horizontal axis. A nozzle 2 is aimed at the rim of the wheel, and a wiper 3 contacts the printing wheel against its direction of rotation. The inking region of nozzle 2 and the contact location of wiper 3 are arranged close together on the lower half of the wheel. A metering valve 6 is arranged in a feed line 5 to nozzle 2. An elongated member to be imprinted can be pulled through the printing device along the line 7 in the direction of the arrow by means of a conventional drawing device. The groove 8*b* is designed so as to conform to the surface of the elongated member to be imprinted. It is not necessary to drive the printing wheel separately, as the drive is accomplished by the drawn elongated member in the so-called "wire drag" mode. The pressure for printing and for driving the printing wheel 4 is produced by the guide pulleys 8. The aperture angle of nozzle 2 is chosen so that the jet remains between the edges 9 of the printing wheel 1, as per FIG. 2. The jet 2 and the wiper 3 both are adjustable parallel to the axis 10 of the printing wheel.

The shaft 11 for the printing wheel 1 is mounted on a slide 12, which is guided in a supporting frame 13. Slide 12 can be removed from the operating position by being lowered by means of a pneumatic system 14. Raising slide 12 by pneumatic system 14 brings printing wheel 1 into the operating position again. In addition to shaft 11 for the printing wheel 1, nozzle 2, wiper 3 and a collecting tray 15 are also mounted on slide 12. The nozzle may be permanently mounted in the collecting tray and adjusted on support arms 16 and 17 axially and radially relative to printing wheel 1. Wiper 3 is pressed against the wheel by a spring 18, and it can be adjusted in its mounting 19 axially with respect to the printing wheel.

Printing ink from a supply tank 20 can be fed to nozzle 2 via metering valve 6 and supply line 5 by means of an ink pump 21. The excess ink wiped off by wiper 3 drips into the collecting tray 15 and returns to the supply tank 20 via a return line 22, thereby closing the ink loop.

Figure 1:
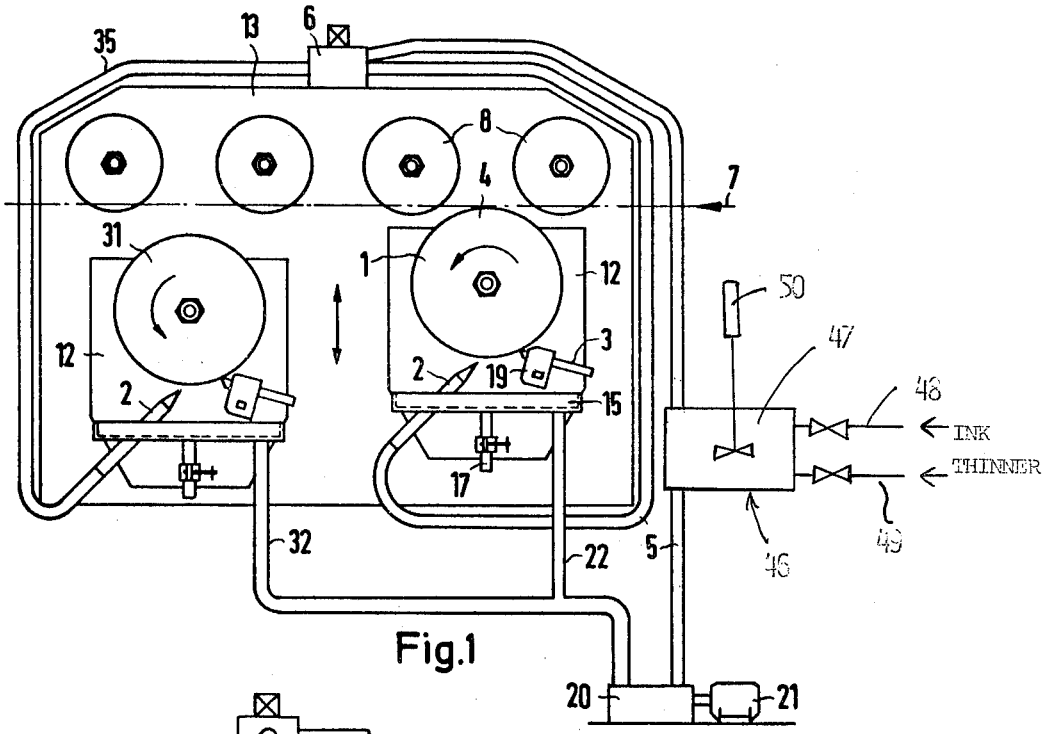
FIG. 1 is a side view of the printing apparatus.

In addition to the printing wheel 1, which is in the printing position, the printing apparatus shown in FIG. 1 has a further printing wheel 31 supported in a further slide, which is designed like slide 12 for printing wheel 1. An ink feed line 35 leads from metering valve 6, which in the example of the embodiment is a three-way valve, to the nozzle for wheel 31, and an ink return line carries the excess ink back to supply tank 20.

Figure 3:
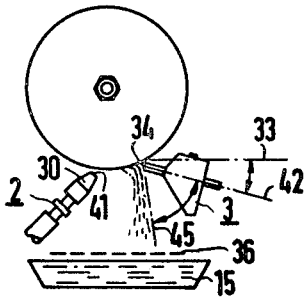
FIG. 3 shows the relative position of the printing wheel, the nozzle, and the wiper.

The wiper 3 according to FIG. 3 makes an angle of preferably 5° to 8° between its imaginary axis 42 (parallel to the top surface) and the horizontal 33. The end face 34 of the wiper is bevelled preferably at an angle of 75° with the wiper axis 42. Between the wiper 3 and the collecting tray 15, a screen 36 is arranged as a jet-breaking means intersecting the plane of the imagined extension 45 of the bevelled end face 34 of wiper 3. The fineness of the screen is about 100 to 200 meshes per $cm^2$.

A device 46 for adjusting the viscosity of the printing is provided in the feed line 5. Device 46 includes a mixing zone 47 for ink from a supply line 48 and a thinning medium from a supply line 49. A stirring mechanism 50 assures thorough mixing of the ink and thinning medium.

Figure 5:
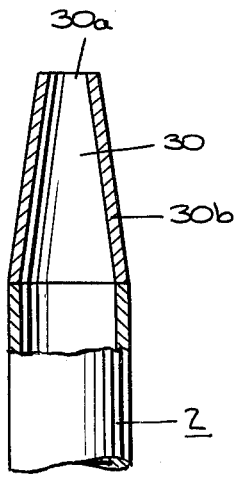
FIG. 5 is a partial, cross-sectional enlarged view of the nozzle.

As shown in FIG. 5, the nozzle 2 includes a neck region 30 adjacent the exit aperture 30*a* having a length greater than the diameter of the exit aperture. The wall thickness 30*b* of the nozzle at the exit aperture is less than the diameter of the exit aperture.

I claim:

1. Apparatus for imprinting the surface of an elongated member moving at high speed, the apparatus including a rotatable printing wheel having a rim having edges formed with a circumferential groove conforming to the surface to be imprinted and depressed printing markings formed in the surface of the groove; means for engaging the rim of the printing wheel in tangential, non-slip, frictional contact with the elongated member while the member is drawn longitudinally at high speed; a nozzle positioned for aiming an ink jet at a region of the grooved rim of the wheel spaced from the area of contact with the elongated member, the nozzle producing an ink jet having an aperture angle within the edges of the rim; and a wiper disposed in a direction against the direction of wheel rotation, contacting the wheel at a location following the inking region, wherein the improvement comprises:

the printing wheel being mounted for rotation about a horizontal axis, with the inking region and the wiper contact location being on the lower half of the wheel, and the wiper having an end face bevelled at an angle between about 65° and 85° with respect to a top surface of the wiper, the wiper being positioned so that an upper edge of the end face contacts the groove surface of the printing wheel between the edges of the rim, with the top surface extending from the contact edge at an angle between about 3° and 10° below the horizontal.

2. Printing apparatus according to claim 1 wherein the nozzle comprises:

a neck region adjacent the exit aperture having a length greater than the diameter of the exit aperture, and the wall thickness of the nozzle at the exit aperture being less than the diameter of the exit aperture.

3. Printing apparatus according to claim 1 comprising:

a frame;

means for guiding the drawn elongated member on a fixed axis with respect to the frame;

a support member for the printing wheel, the nozzle, and the wiper, the support member being mounted on the frame for relative movement with respect to the axis of the elongated member for moving the printing wheel selectively into and out of engagement with the elongated member.

4. Printing apparatus according to claim 1 comprising:

a collecting tray mounted below the printing wheel for collecting excess ink and a screen having approximately 100 to 200 meshes per $cm^2$ positioned over the collecting tray and intersecting the extended plane of the end face of the wiper to break the jet and prevent splashback from the tray.

5. Printing apparatus according to claim 1 comprising:

a conduit for feeding ink to the nozzle and means in the conduit for adjusting the viscosity of the printing ink.

6. Printing apparatus according to claim 5 wherein the means for adjusting the viscosity of the printing ink comprises:

a mixing zone for mixing ink and a thinning medium and a stirring mechanism in the mixing zone.

* * * * *